United States Patent [19]

Karlsson et al.

[11] Patent Number: 4,919,236

[45] Date of Patent: Apr. 24, 1990

[54] SCREW LIFT

[75] Inventors: Klas Karlsson, Spånga; Rune Bergvall, Bro, both of Sweden

[73] Assignee: NTD Hiss Nartransportdon AB, Sweden

[21] Appl. No.: 33,089

[22] PCT Filed: May 30, 1986

[86] PCT No.: PCT/SE86/00248

§ 371 Date: Jun. 12, 1987

§ 102(e) Date: Jun. 12, 1987

[87] PCT Pub. No.: WO86/07041

PCT Pub. Date: Dec. 4, 1986

[30] Foreign Application Priority Data

May 31, 1985 [SE] Sweden ..... 8502693
Mar. 20, 1986 [SE] Sweden ..... 8601313

[51] Int. Cl.[5] ..... B66B 11/04

[52] U.S. Cl. ..... 187/25; 187/136; 464/42; 74/412 TA

[58] Field of Search ..... 187/24, 25, 116, 136; 254/95, 96, 97; 74/424.8 R, 424.8 A, 412 TA, 441, 89.15; 464/42, 43, 44, 30; 192/56 R, 56 L

[56] References Cited

U.S. PATENT DOCUMENTS

| | | | |
|---|---|---|---|
| 244,091 | 7/1881 | Tenney | 464/42 |
| 1,113,744 | 10/1914 | Bjorkstrom | 187/25 |
| 1,235,940 | 8/1917 | Shipman | 464/44 |
| 1,550,936 | 8/1925 | Veith | 464/42 |
| 2,527,897 | 10/1950 | Todd | 187/25 |
| 2,802,549 | 8/1957 | Izquierdo et al. | 187/25 |
| 3,687,234 | 8/1972 | Gendreau | 187/25 |
| 3,799,292 | 3/1974 | Katz | 187/25 |
| 4,102,437 | 7/1978 | Mandel | 187/136 |
| 4,128,142 | 12/1978 | Satoh et al. | 187/116 |
| 4,375,770 | 3/1983 | Druet | 74/424.8 A |
| 4,440,266 | 4/1984 | Kohler | 187/29 |
| 4,644,811 | 2/1987 | Tervo | 187/25 |

FOREIGN PATENT DOCUMENTS 445060 2/1968 Switzerland .

*Primary Examiner*—H. Grant Skaggs
*Assistant Examiner*—Kenneth Noland
*Attorney, Agent, or Firm*—Limbach, Limbach & Sutton

[57] ABSTRACT

A screw lift comprises a lift car (2) which is movably supported on an upright fixed screw (4) and carries a nut (54) in engagement with the screw and a belt drive for rotating the nut on the screw and thereby driving of the lift car along the screw. The nut (54) is rotatably journalled in a lubrication and bearing housing (62), which is connected with the lift car (2) and out of which it extends with a portion, that widens essentially conically and carries a belt pulley (56) with a correspondingly conically shaped hole. The belt pulley and the nut are mutually somewhat axially shiftable. A pulse transmitter (130,132) is arranged as the only position, direction and velocity determining device for the lift for sensing the position of the nut on the screw and emitting signals corresponding thereto.

18 Claims, 5 Drawing Sheets

SCREW LIFT

Figure 1:
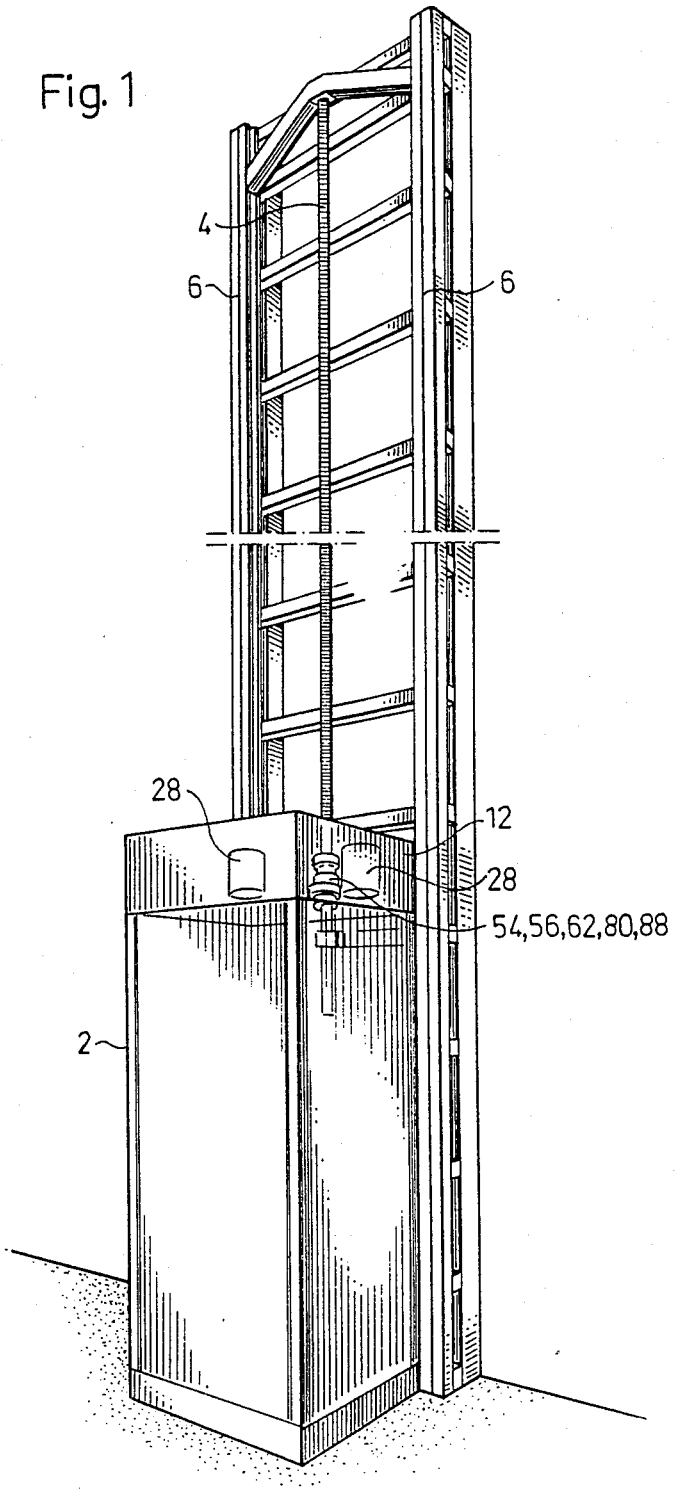

The present invention relates to a screw lift comprising a lift car movably supported along an upright fixed screw and carrying a nut in engagement with said screw, and drive means including at least one electric motor for rotation of the nut on the screw and thereby driving of the lift car along the screw.

A number of different screw lift constructions of this type or similar are known since long. They have only proved to be useful to a limited extent and for quite particular purposes and are, in general, not particularly suitable for conveyance of passengers in houses and the like. The reason is a slow motion of the lift car, a transport height that is limited due to the screw, risk for appearance of destructable forces between the nut and the screw, when the lift car impacts an exterior obstacle, e.g. reaches the bottom, and a delicate and expensive design, generally for eliminating disadvantages of this type.

One object of the invention is to provide a screw lift which, by means of a simple and little cost and space requiring construction, permits a solution to the above and similar problems and thereby is well suited for use for personal conveyance in houses.

This object has been attained in that, in the screw lift according to the invention, the nut is rotateably journalled in a bearing and lubrication housing, and carries the lift car via a belt pulley driven by the motor, said belt pulley being disengageable from the nut when the lift car impacts an exterior obstacle.

A further object of the invention is to provide, in a screw lift of the kind indicated by way of introduction, where the drive means, comprises at least one electric motor provided with a drive circuit, control means for the drive of the lift, which fulfil the requirements on a modern lift for personal conveyance with respect to security, landing accuracy and so on, while maintaining a simple, cheap and little space requiring design of the lift plant in its entirety.

This object has been attained according to the invention in that, a pulse transmitter by sensing and/or determining the position of the nut on the screw is arranged to provide signals corresponding to the position, direction of movement and velocity of the lift car, and in that a control unit, in response to said signals and to manoeuvering signals transmitted from the lift car, is arranged to control said drive curcuit for operating the electrical motor as desired.

Preferred embodiments of the invention appearing from the subclaims involve optimum use of the basic ideas of the invention.

The invention shall now be described more closely with reference to embodiments shown on the attached drawings.

In the drawings

Figure 2:
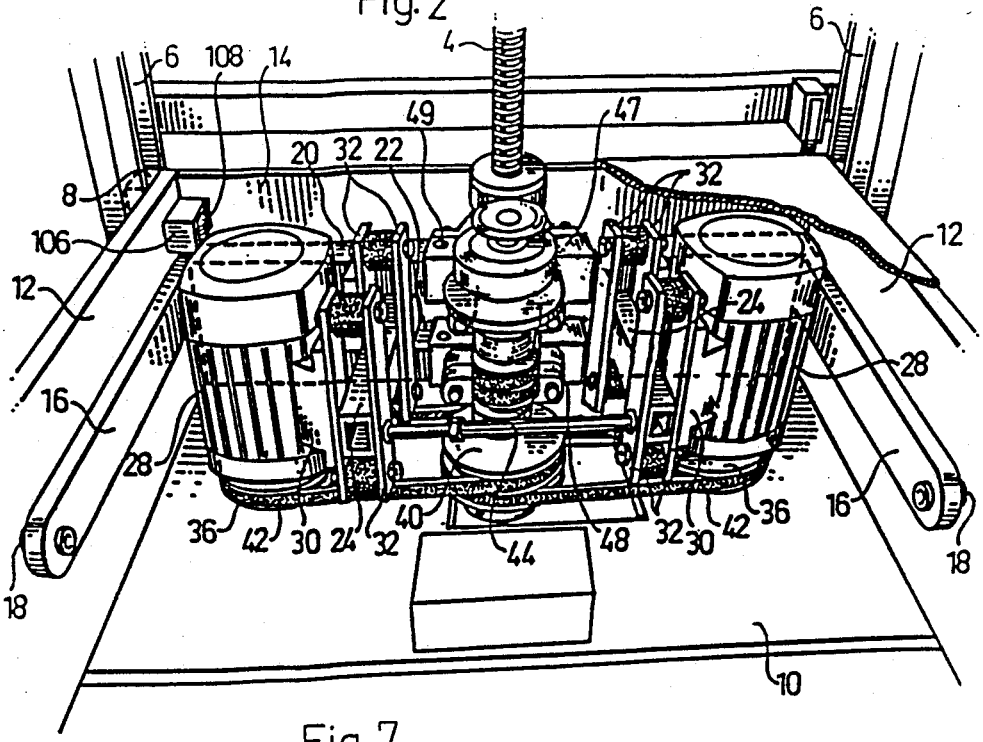
Figure 7:
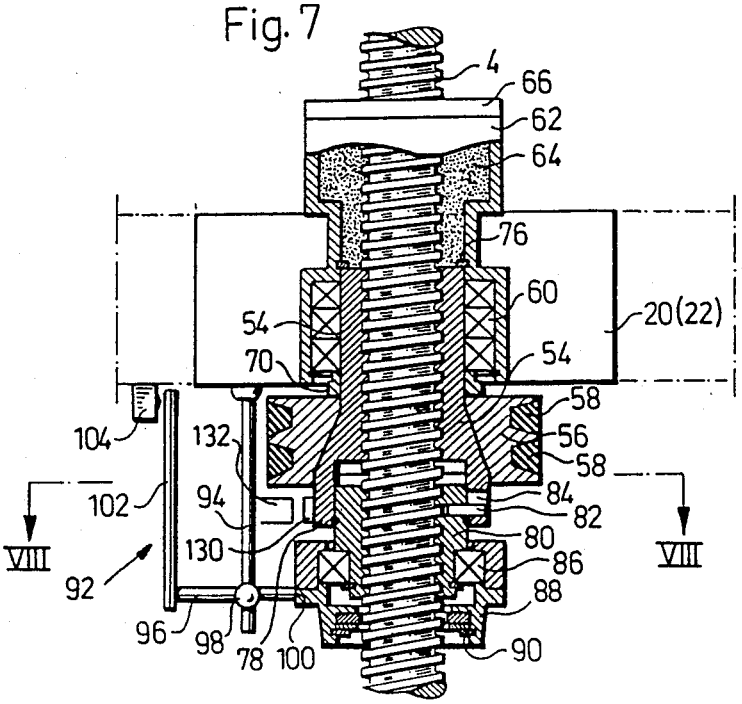
Figure 3:
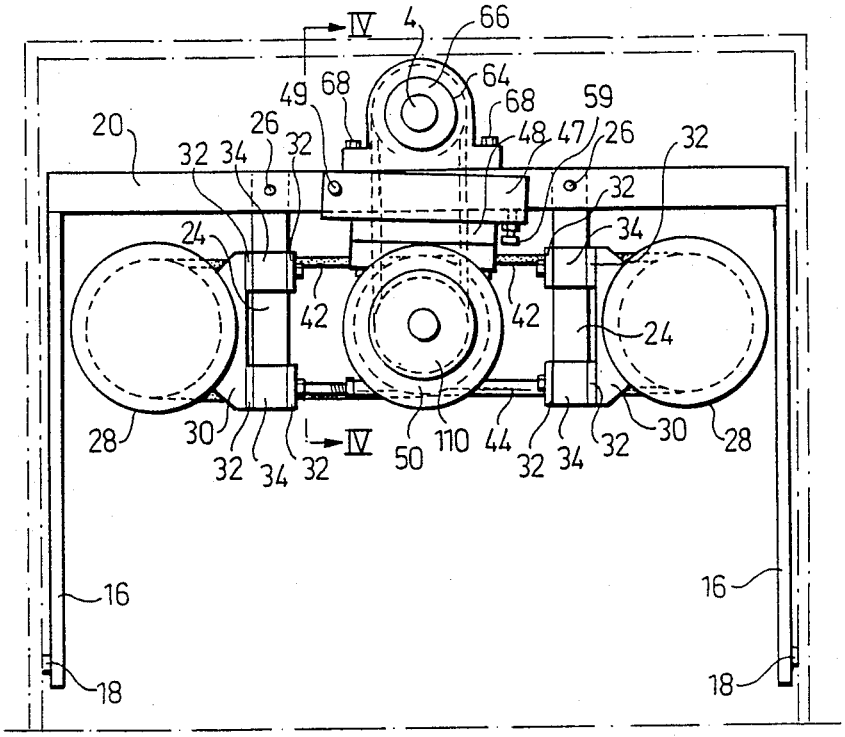
Figure 4:
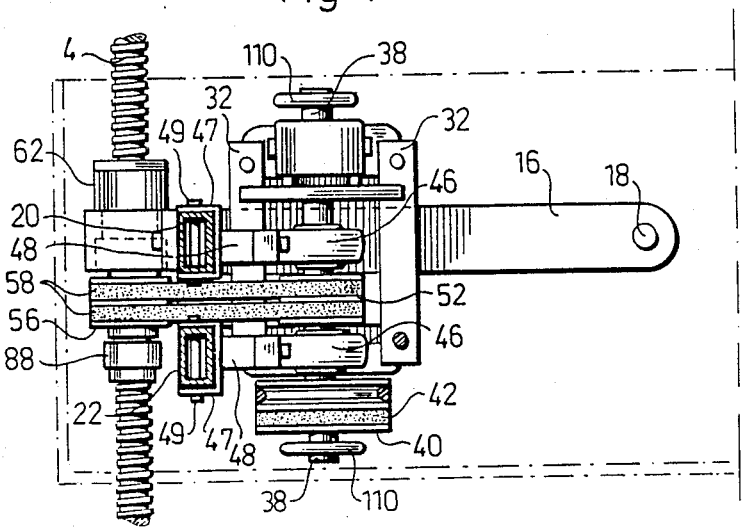
Figure 5:
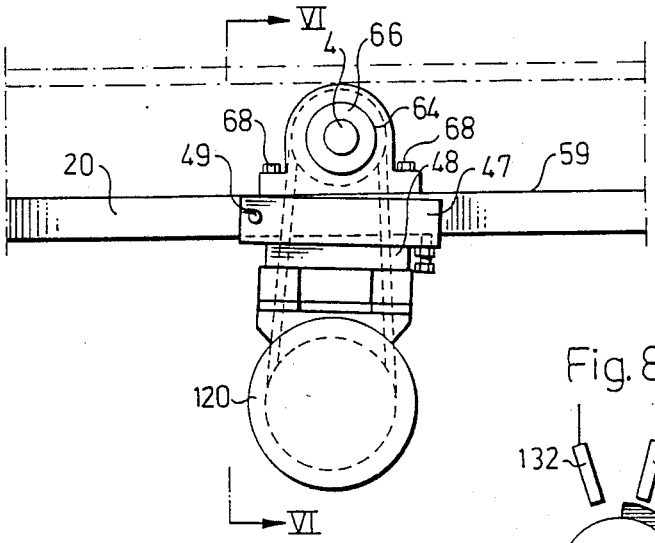
Figure 8:
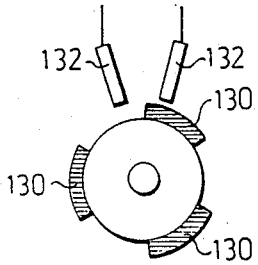
Figure 6:
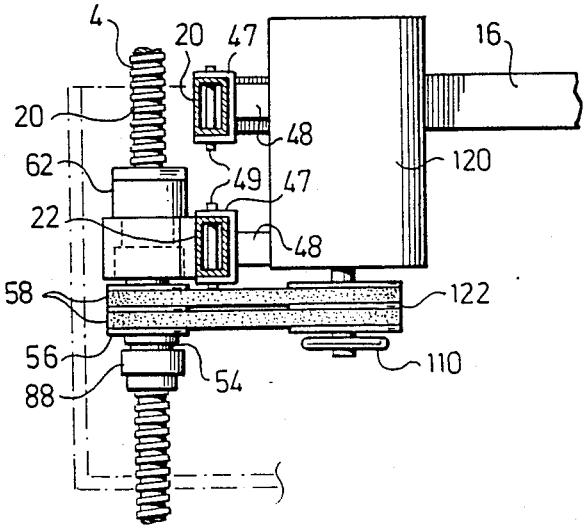
Figure 9:
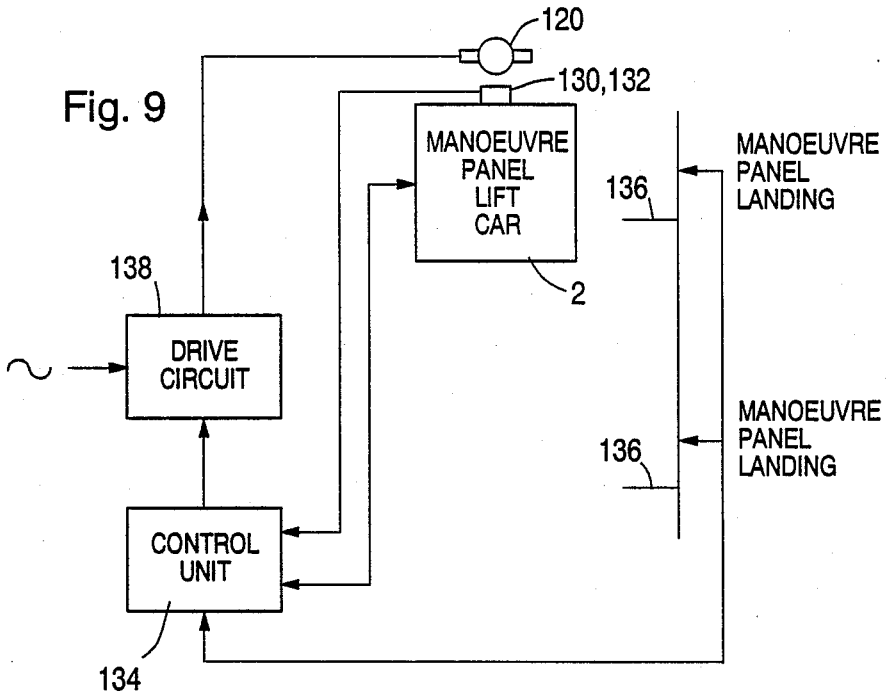
Figure 10:
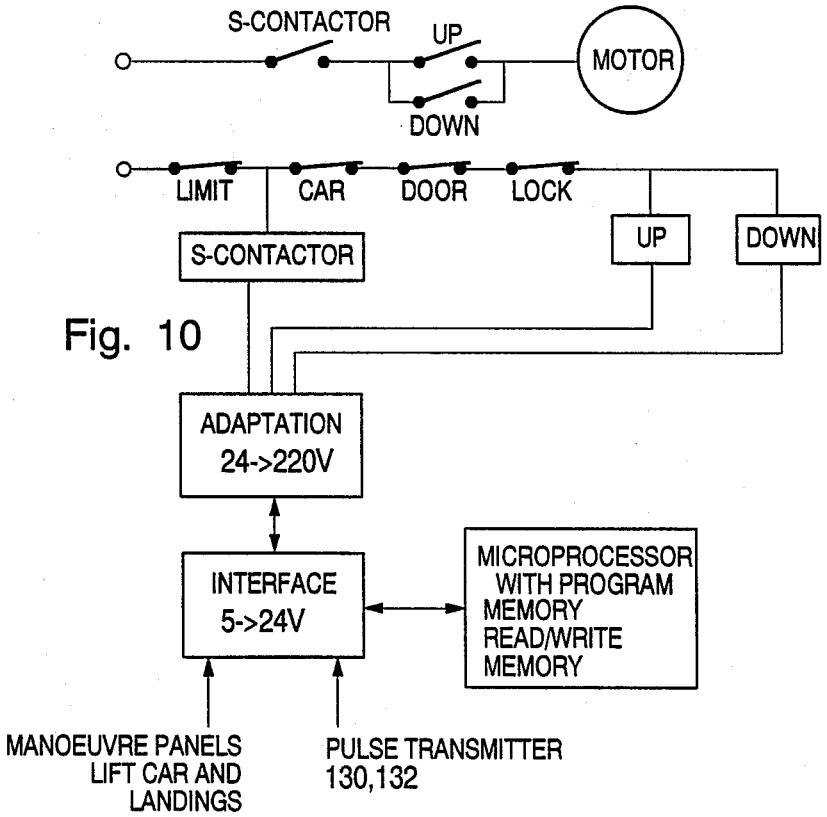

FIG. 1 is a simplified perspective view of one embodiment of the screw lift according to the invention, FIG. 2 is a likewise partly simplified perspective view of the drive unit of the screw lift as seen obliquely from above and from the front towards the roof of the lift car of FIG. 1, with omission or cutting away of portions less essential to the invention for the sake of clearness, FIG. 3 is a corresponding plan view of the drive unit FIG. 4 is a section in the direction of arrows IV—IV in FIG. 3, FIGS. 5 and 6 are views partly similar to those in FIGS. 3 and 4 illustrating an alternative simpler embodiment of a drive unit for a screw lift, FIG. 7 is an axial section through the nut and the portions cooperating therewith, FIG. 8 is a section in the direction of arrows XIII—XIII in FIG. 7; and, FIGS. 9 and 10 schematically illustrate portions of the electric drive and control system of the lift, essentially in block diagram form.

The screw lift illustrated in the drawings includes a lift car 2. The lift car 2 is movably supported along an upright fixed screw 4, preferably with at least two parallel threads. More particularly this support includes guide beams 6 extending along the screw 4. FIG. 2 indicates how the guide beams 6 can be U-shaped and receive blocks 8 of teflone or the like, which are attached to the sidewall of the lift car at the rear end thereof. Of course, a number of such blocks 8 are then arranged along each vertical rear corner of the lift car.

The lift car 2 includes a roof 10 located over the passenger's space, sidewalls 12 and a rear wall 14. The passenger's space is limited by a wall not shown on the drawings and located inside the wall 14. The screw 4 extends between said wall and the wall 14.

All components of the drive unit of the lift are carried by a common support frame. This support frame in turn is carried by arms 16 each extending along its wall 12. The arms 16 at their forwards ends are pivotally connected with the corresponding wall 12 by a horizontal pivot 18. At the rear ends thereof the arms 16 are completely connected by means of a transversely extending framework including an upper horizontal beam 20 and a lower horizontal beam 22. Between the beams 20 and 22 two motor support beams 24 are pivotally attached at one end thereof on vertical pivot pins 26 which extend through the beams 20, 24, and 22.

Each motor suport beam 24 carries an electric motor 28 arranged with its drive shaft vertically extending. More particularly, each electric motor 28 is carried at its attachment 30 by means of a system of two pairs of parallel and vertically arranged support arms 32. At each end of each pair of the support arms 32 a chock absorbing spring body 34 is biased between the arms of the pair. The elements 30, 32, and 34 are mutually interconnected and carried by the motor support beams 24 in a way easily conceivable to the man of the art in order to carry the motors 28 elastically and chock absorbing.

The output end of the drive shaft of the motors 28 at each motor carries a belt pulley 36. Between the motors 28 and parallel to these a central drive shaft 38 is carried by the support framework 20, 22 in a way to be described more closely below. At its lower end the drive shaft 30 carries a double belt pulley 40. Around each motor belt pulley 36 and the belt pulley 40 an endless drive belt 42 extends. The tension of the drive belts 42 can be set to a suitable value by means of a settable set screw 44 clamped between the front pairs of motor support arms 32 and acting between said two support arm pairs 32 on level with their respective motor support beams 24.

The shaft 38 is rotatably supported in two bearing brackets 46, which are bolted to each its short U-beam 47 by means of corresponding respective attachments 48. Each U-beam 47 from the side facing the shaft 38 embraces a corresponding one of the support frame beams 20 and 22, respectively, and at one of its ends is pivotally connected to the same by means of a vertical pivot pin 49. The angular position of the U-beams 47 with respect to the beams 20 and 22, respectively, is settable for a purpose to be described more closely below.

Between the bearings 46 and the shaft 38 carries a further belt pulley 52. At level with the belt pulley 52 a nut 54, to be more closely described below, is arranged on the screw 4. The nut 54 carries a belt pulley 56, in a way likewise to be described more closely below. Around the belt pulleys 52, 54, endless drive belts 58 extend. At the other end of the U-beams 47 a set screw 59 is arranged to act between the corresponding beam 20 and 22, respectively, and the beam 47 such that the distance between the screw 4 and the drive shaft 38 can be set by rotation around the pivot 49 to a value suitable for the tension of the belts 58.

The nut 54 is rotatably journalled by means of bearings 60 in the lower part of a bearing and lubrication housing 62. Above the nut 54 the housing 62 contains a lubricating grease chamber 64, which is closed by means of a lid 66 at its tip. Between the lid 66 and the screw 4 annular seals as well as guiding means for the housing 62 and thereby the nut 54 on the screw 4 are arranged in a suitable way not shown. The annular seals glide on the screw 4 and considerably suppress ejection of lubricating grease. The housing 62 is attached by means of bolts 68 to the beam 20.

As illustrated in FIG. 7 the nut is widening conically downwardly from the housing 62 and the belt pulley 56 has a corresponding conical shape of its bore cooperating with the nut 54. In operation the lift car 2 is carried by the belt pulley 56 on the nut 54 via a support ring 70 located between the belt pulley and the inner bearing rings of the bearings 60 in engagement with the nut. FIG. 7 illustrates this loaded condition. The nut 54 is limitedly axially slidable in the inner bearing rings of the bearings 60 when the nut is exposed to a downwardly directed force. A stop ring 76 arranged at the upper end of the nut 54 limits such movement upwardly. At its lower end the nut 54 is ended by a cylinder shaped portion 78, in which a security nut 80 engages, which is likewise running on the screw 4. The security nut 80 is unrotatably but slightly axially movably connected to the nut 54. More particularly a pin 82 in the nut 80 engages an axial slit 84 in the nut 54. The nut 80 is rotatably journalled by means of a bearing 86 in a bearing housing 88, which in its lower portion has a sealing means against the screw 4, that slides against the screw 4 and considerably suppresses ejection of lubricating grease. At 90 sealing means for the housing 88 and thereby the nut 80 on the screw 4 are also arranged.

The housing 88 is unrotatably carried by the beam 70 via a link system generally designated 92. More particularly the link system 92 includes a rod 94 which is rigidly attached to the beam 20 and at which a transverse rod 96 is pivotally connected at 98. The rod 96 is interconnected with the housing 88 at its one end 100 by means of a pivot, not shown, that allows a limited angular setting of the rod 96 with respect to the housing 88, when the rod 96 moves around the pivot 98. At the other end of the rod 96 a vertically extending rod 102 is attached which at its upper end is arranged in the vicinity of a contact breaker 104. The breaker 104 is included in a circuit for braking upward movement of the lift car at a greatest allowable degree of wear on the threads of the nut 54. With increasing wear the nut 54 and thereby the beam 20 approaches the security nut 80, which in turn involves that the rod 94 presses down the rod 96 which is thereby exposed to a small pivoting around its inner pivot 100 and the pivot 98. Of course, this in turn implies that the rod 102 approaches the breaker 104 until it reaches the same and actuates it. The realization of said breaking circuit is easily conceivable to the man of the art and need therefore not be disclosed more closely here.

If the lift car impacts an exterior obstacle, e.g. reaches bottom, the nut 54 is pressed, due to reaction, to move axially downwardly a limited distance with respect to the inner bearing rings of the bearings 60. Thereby the belt pulley 56 is relieved from the weight of the lift car 2 since the belt pulley 56 and the support ring 70 follow the short axial movement of the nut. At continued rotation, if any, of the belt pulley 56 after the nut has reached its lower position of limit, the engagement between the conical surfaces of the nut 54 and the belt pulley 56 is released, so that the forces acting between the screw and the nut disappear. Hereby the appearance of destroying forces in the mechanism is prevented.

Limiting stops 106 are arranged at each point of connection between the respective arms 16 and the beam 20. Of these limiting stops only one can be seen in FIG. 2. The limiting stop is combined with a resilient means, indicated at 108, and an overload breaker, not shown, between the arm 16 and the limiting stop 106. The overload breaker is preferably realized with delay in order to prevent opening at overloads of instantaneous type. The realization of such a type of device is evident to the man of the art and need therefore not be described more closely here. At each end of the shaft 38 there is furthermore a manoeuvring wheel 110 intended for manual manoeuvring of the lift in case of current drop out or emergency stop. The lower wheel 110 is used if the lift car is located at the top so that the upper wheel is not available. The lower wheel 110 can be reched via a scuttle, indicated at 112, in the roof of the lift car. It is, however, simpler to stand on the roof of the lift car and manoeuvre the upper wheel 110, which, of course, can be done only if the lift car by means of the lower wheel 110 is first manoeuvred down from its top position. The lift car roof can then be reached via a scuttle not shown.

From the above description it should have been clear that all components of the drive unit according to FIGS. 2–4, including the motors 28, the shaft 38 and the nut 54 with its housing 62 are carried by one and the same support frame, including the arms 16 and the beam system 20, 22, 24.

A screw lift of the kind described above has a number of essential advantages. The mechanical arrangement builds upon a self-braking screw-nut construction. The location of the drive unit on the lift roof makes the construction compact and simple.

With the drive and control system schematically shown in FIGS. 9 and 10, such a screw lift construction can be controlled in a very advantageous way.

Although, per se, such a control system to advantage also can be used in a motor system of the kind described above with two motors 28 and intermediate shaft 38, it is here presupposed that a motor arrangement of the kind indicated in FIGS. 5 and 6 is used.

In the embodiment according to FIGS. 5 and 6 parts similar to those of the earlier embodiment or similarly acting, have been provided with the same reference numerals. As can be seen only a single motor 120 here drives the belt pulley 56 via a belt pulley 122. The bearing housing 62 is attached to the lower beam 22, which is also indicated in FIG. 7 by (22) after the reference numeral 20. The elements 48 in a settable way carry the motor 120 the same way as the bearing brackets 46 are settably supported in the embodiment according to FIGS. 3 and 4.

In association with the drive nut 54 an inductive pulse transmitter is arranged, which senses the position of the nut on the screw 4 and emits pulses indicating the same. More particularly, the pulse transmitter includes three iron elements 130 uniformly arranged around the periphery of the nut 54 and two sensors 132 cooperating therewith, which are fixedly arranged with respect to the lift car. Each sensor 132 at the passage of the iron elements emits a pulse train. The phase shift between the pulse trains indicates the rotational direction of the nut 54 and thereby the direction of movement of the lift car, whereas the number of pulses indicates the position of the lift car along the screw 4.

An inductive pulse transmitter of the kind indicated above is well known to the man of the art and its closer details need therefore not described more closely here. The man of the art furthermore realizes how similar signal producing arrangements in association with the nut for sensing the position of the lift are also conceivable by means of e.g. magnetic, capacitive and optical sensors.

The two pulse trains are fed to a control unit 134, which by counting the number of incoming pulses determines the position of the lift car by comparing the pulse number with pulse numbers programmed into a memory for each landing. Zero setting can then be carried through at one of the end positions of the lift car and counting up or down is determined by the mutual phase position of the two pulse trains.

More particularly, the control unit 134 can be of the kind, known per se, that is marketed by the company Hisstema, Stockholm and Södertälje, or of the kind described in e.g. the Swedish patent application No. 8007272-1.

In short, such a control unit, known per se, contains a logic unit including a central processor, a program memory and a computer memory, where the central processor carries through operations in accordance with instructions stored in the program memory and reads and stores the information from and in the computer memory, respectively.

Besides receiving signals from the pulse emitter 130, 132 the control unit 134 receives signals from control panels at the landings 136 of the lift installation and in the lift car 2, as indicated in FIG. 9.

In response to the signals thus received from the pulse emitter 130, 132 and the control panels, the control unit 134 controls the drive circuit 138 of the motor 120 which is indicated in FIG. 9 and somewhat more in detail shown in FIG. 10 so that the lift car 2 is controlled by the motor 120 as instructed. In FIG. 10 the two blocks "Interface" and "Microprocessor" correspond to the control unit 134 and the rest of FIG. 10 corresponds to the drive circuit 138. Also this can be technique well known to the man of the art.

In the present case the car is quite simply stopped by braking the motor current. For most cases at light personal lift cars this is enough to obtain a landing accuracy of ±10 mm.

A further possibility to attain an exact and accurate brake operation is, according to one embodiment, to let the drive circuit revert the motor current.

In both cases the mechanical brakage is obtained by the self-braking screw-nut construction.

As should have appeared from the above the moment to affect the current supply to the motor is determined by comparing the pulse trains obtained from the pulse emitter and the control signals from the landings and the lift car with lift information stored in the control system, such as the positions of the landings, retardation and acceleration values for the lift car etcetera.

The pulse emitter 130, 132 is quite enough for determining the position, direction and velocity of the lift car, thus eliminating the need for contacts, flags and similar in the lift shaft, such as in earlier known lifts.

We claim:

1. A screw lift comprising a lift car which is movably supported along an upright fixed screw, said lift car carrying a drive nut in engagement with said screw and with belt drive means including at least one electric motor for rotation of said drive nut on said screw, said lift car thereby driven along said screw, and said drive nut rotatably journalled in a lubrication and bearing housing connected with said lift car, said drive nut carrying said lift car via a belt pulley driven by said belt drive means electric motor, said belt pulley disengageable from said drive nut when said lift car impacts an exterior obstacle such that when said lift car impacts an exterior obstacle at the bottom of said lift car, said lift car is displaced vertically thereby vertically displacing said belt pulley to completely disengage said belt pulley from said drive nut.

2. A screw lift according to claim 1, wherein said drive nut extends downwardly out of said lubrication and bearing housing with an essentially conically widened portion, on which said drive nut carries said belt pulley, which during operation of said screw lift carries said lift car via said lubrication and bearing housing, said drive nut being limitedly axially slidable downwardly in said lubrication and bearing housing such that if, at stop of said lift car, said drive nut is exposed to a continuing rotational force via said belt pulley, so that said drive nut and said belt pulley are relieved from the weight of said lift car, said engagement between said drive nut and said belt pulley is released when said drive nut reaches its lower limit position along said screw.

3. A screw lift according to claim 1 or 2, wherein said drive nut below said belt pulley ends in a cylindrical portion, which is coaxial with said screw and which portion receives an upper portion of a security nut which is likewise travelling on said screw, and said security nut is non-rotatably but axially limitedly movably connected to said drive nut, and said screw lift further comprising means for sensing when the distance between said driving and said security nuts falls below a predetermined limit value due to wear of the threads of said drive nut.

4. A screw lift according to claim 3, wherein said distance sensing means includes a link system which is arranged between a bearing housing for said security nut and a security switch, said bearing housing enclosing said security nut at its lower end and comprising sealing means between said housing and said screw.

5. A screw lift according to claim 1, wherein said belt drive means and said driving nut are carried by a common support frame, which is interconnected with said lift car via connection means, which connection means permits a certain mobility in the direction of said screw, said belt drive means and said drive nut with respect to said lift car.

6. A screw lift according to claim 5, wherein said connection means consists of arms carrying said common support frame and pivotally connected to said lift car at a distance from said common support frame on pivots extending transversely to the direction of said screw, limiting stops being arranged for upward movement of said common support frame with respect to said lift car.

7. A screw lift according to claim 6, wherein said limiting stops are resilient.

8. A screw lift according to claim 6 further comprising an overload circuit breaker for a drive circuit of said belt drive means electric motor, said overload circuit breaker being set to open above a minimum threshold pressure level to prevent said drive circuit from opening at temporary overloads.

9. A screw lift according to claim 1 wherein said belt drive means further comprises a rotatable shaft, which is parallel to said drive nut and drivably connected to said belt drive means electric motor and drivingly connected to said drive nut.

10. A screw lift according to claim 9, wherein said rotatable shaft carries two belt pulleys, a first belt pulley which is connected by drive belts to first and second drive pulleys supported on the shafts of two drive motors, and a second belt pulley is connected by means of drive belts to a third drive pulley carried by said drive nut.

11. A screw lift according to claim 10, wherein said common support frame carries said first and second drive pulley motors, said drive nut and said rotatable shaft by means of attachments which are settably and pivotably connected to said common support frame via connection means parallel to said rotatable shaft, in order to enable belt tension adjustment.

12. A screw lift according to claim 1 with at least one belt drive means electric motor for rotation of said drive nut, having a drive circuit, wherein a pulse transmitter is set by sensing and/or determination of the position of said drive nut on said fixed screw, to transmit signals corresponding to position, direction of movement and velocity of said lift car, and having a control unit which is arranged, in response to said signals and control signals emitted from said lift car, to control said drive circuit for controlling said belt drive means electric motor.

13. A screw lift according to claim 12, characterized in that the control of the drive circuit is carried through by comparison of said velocity, direction of movement and position signals and said control signals with lift information stored in a memory device, such as positions of landings, allowable retardation and acceleration values for the lift.

14. A screw lift according to claim 12 in the absence of a special brake device.

15. A screw lift according to claim 12, wherein said pulse transmitter is sufficient as position, direction and velocity determining means for said lift, such that contacts and flags in the lift shaft are dispensable.

16. A screw lift according to claim 1, wherein said drive nut extends downwardly out of said lubrication and bearing housing with an essentially conically widened portion on which said belt pulley is carried, and further comprising means for allowing limited axial sliding movement of said drive nut in said lubrication and bearing housing in case of said lift car impacting an exterior obstacle.

17. A screw lift which comprises:

a lift car which includes an arrangement which is movably supported along an upright fixed screw and which carries a drive nut in engagement with said fixed screw;

at least one electric motor, having a drive circuit, said motor adapted to cause rotation of said driven nut on said fixed screw, thereby driving said lift car along said fixed shaft;

pulse transmitter means in communication with drive circuit control means wherein said pulse transmitter means obtains the position of said drive nut along said fixed screw, and said pulse transmitter means transmits signals corresponding to the position, direction of movement and velocity of said lift car, and corresponding to control signals emitted from the lift car, to said drive circuit control means, wherein said drive circuit control means controls said drive circuit and said electric motor;

and wherein said pulse transmitter means is sufficient as position, direction and velocity determining means for said screw lift such that contacts and flags in the lift shaft are dispensable.

18. A screw lift according to claim 17 in the absence of a special brake device.

* * * * *